United States Patent [19]

Kawamura

[11] Patent Number: 4,909,230

[45] Date of Patent: Mar. 20, 1990

[54] HEAT INSULATING COMBUSTION CHAMBER AND METHOD OF PRODUCING THE SAME

[75] Inventor: Hideo Kawamura, Samukawa, Japan

[73] Assignee: Isuzu Motors Limited, Tokyo, Japan

[21] Appl. No.: 257,695

[22] Filed: Oct. 14, 1988

[30] Foreign Application Priority Data

Oct. 22, 1987 [JP] Japan ..... 62-265459

[51] Int. Cl.[4] ..... F02B 75/08

[52] U.S. Cl. ..... 123/668; 123/193 CH

[58] Field of Search ..... 123/668, 669, 193 CH, 123/193 H, 193 C

[56] References Cited

U.S. PATENT DOCUMENTS

| | | | |
|---|---|---|---|
| 3,820,523 | 6/1974 | Showalter et al. | 123/669 |
| 4,376,374 | 3/1983 | Bothwell | 123/668 |
| 4,523,554 | 6/1985 | Ryu | 123/668 |
| 4,531,502 | 7/1985 | Mizuhara | 123/668 |
| 4,676,064 | 6/1987 | Naita et al. | 123/193 H |
| 4,838,235 | 6/1989 | Kawamura et al. | 123/193 CH |

FOREIGN PATENT DOCUMENTS

| | | | |
|---|---|---|---|
| 2537676 | 4/1976 | Fed. Rep. of Germany | 123/193 H |
| 7737 | 1/1984 | Japan | 123/193 H |
| 6058824 | 4/1985 | Japan . | |

OTHER PUBLICATIONS

"Ceramic Coating Techniques" published on May 25, 1984 (date of issue) by the Sogo Gijutsu Center K.K. (publishing company), pp. 41–52.

*Primary Examiner*—E. Rollins Cross

*Attorney, Agent, or Firm*—Browdy & Neimark

[57] ABSTRACT

The heat insulating combustion chamber according to the present invention is provided with a surface layer, which faces a combustion chamber, of a head liner consisting of an integrated structure of a lower surface portion of a head and an upper portion of a cylinder liner and made of a thin ceramic layer of the smallest possible thickness, and a heat insulating member, i.e. a heat insulating layer consisting of a porous carbon structure and disposed between the head liner and this thin layer so as to improve the heat insulating functions of the combustion chamber, the thin layer which faces the combustion chamber, and which is heated to a high temperature, being formed to have a small thermal capacity, whereby the suction efficiency in a suction stroke of the engine and the cycle efficiency are improved, the thin layer the strength of which decreases due to the reduction of the thickness of the ceramic material constituting the same being reinforced by a latticed partition inserted in the heat insulating layer so as to support the thin layer, the joint portions of the thin layer and partition being combined firmly with each other. The present invention further provides a method of producing a heat insulating combustion chamber of the above described construction very easily to have a high strength.

10 Claims, 1 Drawing Sheet

HEAT INSULATING COMBUSTION CHAMBER AND METHOD OF PRODUCING THE SAME

BACKGROUND OF THE INVENTION

1. Field of the Invention

This invention relates to a heat insulating combustion chamber for a ceramic engine and the like, and a method of producing the same.

2. Description of the Prior Art

A conventional heat insulating structure for the wall of a combustion chamber in an engine is disclosed in, for example, Japanese Utility Model Laid-Open No. 58824/1985 filed by the applicant of the present invention. The heat insulating structure for the wall of the combustion chamber in an engine is such that a wall member composed of a porous ceramic material having a thickness of not more than 2.0 mm and a porosity of not less than 80%, and a layer of coating of a ceramic material having a thickness of not more than 0.1 mm and formed on the outer surface of the wall member, or a plate of a metal, such as stainless steel bonded to the outer surface of the wall member form an insulating wall, this heat insulating wall being provided on the inner surface of a cylinder head, the top end surface of a piston and the inner circumferential surface of a cylinder liner, which contact a combustion gas in the engine. In such a heat insulating structure for the wall of a combustion chamber for an engine, it is very difficult to combine an outer layer of coating of a ceramic material or a plate of a metal, such as stainless steel with the surface of the wall member of a ceramic material. If the porosity of the wall member is increased, the strength thereof decreases, though the heat insulating performance thereof is improved, so that it becomes more difficult to combine such an outer layer or metal plate with the surface of the wall member. If the wall member is made thicker so as to combine such a layer of coating with the wall member of a ceramic material more easily, the thermal capacity of the wall member increases. Consequently, the temperature in the combustion chamber becomes constantly high, and the suction efficiency in a suction stroke of the engine decreases.

Therefore, there has been a problem of how to construct a heat insulating combustion chamber which is capable of securing its heat insulating functions, and which has a combustion gas-exposed wall surface with the smallest possible thermal capacity and a sufficiently high strength.

The techniques for forming a layer of coating of a ceramic material by chemical vapor deposition have already been disclosed in publications. The chemical vapor deposition is put into practice in various technical fields by utilizing the permeation characteristics thereof. It is utilized for sealing bores, bonding materials and parts, plating inner surfaces of minute bores and narrowly spaced materials and parts, and forming heat resisting, wear resisting and corrosion resisting protective films, decorative films and films of a functional substance having electrical and optical characteristics. A fluidized chemical vapor deposition apparatus uses a starting substances for chemical vapor deposition a coating reagent containing as a main component a substance to be applied to a substrate, and a gas source, such as a carrier gas and a reactive gas mixed with the vapor of the reagent and sending the plating vapor to the surface of the substrate in a reaction chamber. The coating reagent used consists mainly of a volatile metal or a halide, and the carrier gas and reactive gas a simple-substance gas composed of a hydrogen gas in most cases and nitrogen and argon in some cases and a hydrocarbon gas (refer to "Ceramic Coating Techniques" published on May 25, 1984 (date of issue) by the Sogo Gijutsu Center K.K. (publishing company)).

In order to bond or chemically combine a ceramic material, such as $Si_3N_4$ and Si C to or with the wall of a combustion chamber, the chemical vapor deposition is conveniently used. The bonding of, for example, $Si_3N_4$ to the wall of a combustion chamber is effected by mixing gases, such as Si $Cl_4$, $NH_3$ and $H_2$ together, and subjecting the resultant mixed gas to a reaction in a chemical vapor deposition furnace, i.e. a high-temperature furnace.

SUMMARY OF THE INVENTION

A main object of the present invention is to solve the above-mentioned problems and provide a heat insulating combustion chamber in which a surface layer, which faces a combustion chamber, of a head liner consisting of an integrated structure of a lower surface portion of a head and an upper portion of a cylinder liner, is made of a thin ceramic layer of the smallest possible thickness, a heat insulating member, i.e. a heat insulating layer which consists of a porous carbon structure is provided between the head liner and thin layer so as to improve the heat insulating functions of the combustion chamber, the thin layer, which faces the combustion chamber and is heated to high temperature, is formed to have a small thermal capacity, whereby the suction efficiency in a suction stroke of the engine and the cycle efficiency are improved, the thin layer the strength of which decreases due to the reduction of the thickness of the ceramic material constituting the same is reinforced by providing in the heat insulating layer a support member consisting of a latticed partition, and the joint portion between the thin layer and partition is combined firmly with each other.

Another object of the present invention is to provide a heat insulating combustion chamber wherein a latticed partition of a ceramic material is fixed in a standing state to the portion, which is on the side of the combustion chamber, of a head liner consisting of an integrated structure of a lower surface portion of a ceramic material of a cylinder head and an upper portion of a cylinder liner, the exposed surfaces of the carbon powder packed in the spaces between the partitions and the exposed surface of the partitions being coated with a ceramic material by chemical vapor deposition to form a thin ceramic layer.

Still another object of the present invention is to provide a heat insulating combustion chamber wherein the ceramic material in use consists of silicon nitride, the thin ceramic layer being bonded to the partition by chemical vapor deposition.

A further object of the present invention is to provide a heat insulating combustion chamber wherein the partition and the thin layer are combined very firmly by the chemical vapor deposition, oxygen among the particles of the carbon powder packed in the space among the latticed partition body and a part of the carbon powder react with each other during this chemical vapor deposition to generate carbon dioxide, which forms pores in the carbon, these pores forming porous structures in the partition.

A further object of the present invention is to provide a heat insulating combustion chamber wherein the thickness of the surface layer, i.e. the ceramic material constituting the thin layer, which is exposed to a high-temperature combustion gas, of the lower surface portion of the head and the upper portion of the cylinder liner which is opposed to the combustion chamber can be set to the lowest possible level by chemical vapor deposition, the thermal capacity of the thin layer being able to be reduced.

A further object of the present invention is to provide a heat insulating combustion chamber wherein the partition and the thin layer are combined very firmly by chemical vapor deposition, the partition functioning as a reinforcing member for the thin layer, the heat insulating effect of the partition being excellent owing to the heat insulating layer formed therein which consists of carbon and pores in the latticed partition body, the thickness of the ceramic material constituting the thin layer, which is exposed to a high-temperature combustion gas, of the lower surface portion of the head and the upper portion of the cylinder liner which is opposed to the combustion chamber being able to be set to the lowest possible level, the thermal capacity of the thin layer being able to be reduced.

A further object of the present invention is to provide a heat insulating combustion chamber wherein the thin layer of coating of a ceramic material is formed on the inner surfaces of the suction and exhaust ports of a valve in the head liner, so that the heat insulating functions and thermal capacity of the suction and exhaust ports of the valve can be improved and reduced, respectively.

A further object of the present invention is to provide a heat insulating combustion chamber wherein the minimization, which is important for improving the suction efficiency of an engine, of the thermal capacity of an inner ceramic surface the temperature of which becomes high, is effected for the purpose of reducing to the lowest possible level the quantity of heat which the suction air receives from the inner surface of the combustion chamber of the heat insulated engine, i.e., forming the surface of the combustion engine to have a small thermal capacity enabling the same surface to be cooled immediately with the suction air at a suction stroke of the engine, so that a difference between the temperature of the suction air and that of the surface of the combustion chamber becomes small, whereby the suction air flows in easily at a suction stroke, the quantity of heat absorbed by the surface of the combustion chamber at the time of a maximum temperature in the combustion chamber being reduced to make small a difference between the temperature of the combustion gas and that of the surface of the combustion chamber, the quantity of thermal energy, which escapes to the outside via the cylinder head and cylinder block without being held by the head liner at the explosion and exhaust strokes, being able to be minimized, whereby it becomes possible to send the thermal energy in the combustion chamber to an energy recovery unit, which is provided at the downstream side, at a maximal rate through an exhaust port, so that the thermal energy can be recovered at a maximal rate.

A further object of the present invention is to provide a method of producing very easily a heat insulating combustion chamber having a high strength.

DESCRIPTION OF THE PREFERRED EMBODIMENT

An embodiment of the heat insulating combustion chamber according to the present invention will now be described with reference to the drawings.

Figure 1:
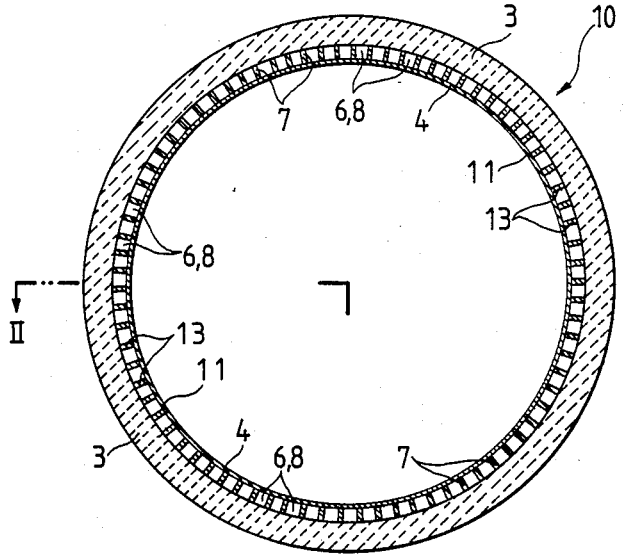
FIG. 1 is a sectional view, which is taken along the line I—I in FIG. 2, of an embodiment of the heat insulating combustion chamber according to the present invention.
Figure 2:
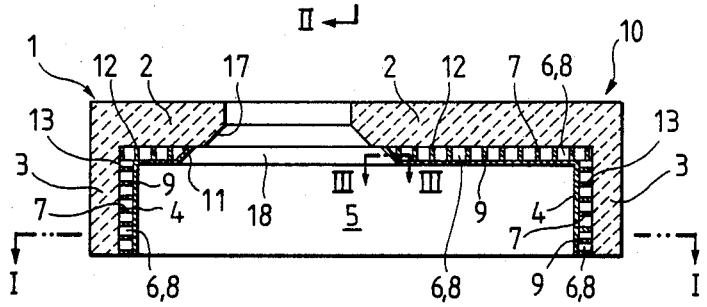
FIG. 2 is a sectional view taken along the line II—II in FIG. 1.

In FIGS. 1 and 2, a heat insulating combustion chamber according to the present invention is designated generally by a reference numeral 10. This heat insulating combustion chamber 10 is applied to a head liner 1, and discloses the technical concept connecting the heat insulating structure for a lower surface portion 2 of a head and an upper portion 3 of a cylinder liner 3 which constitute a head liner 1 in the heat insulated engine. The technical concept of the heat insulating combustion chamber 10 can, of course, be applied to a piston head. The heat insulating structures for a cylinder, a piston and suction and exhaust valves, which are other than the above-mentioned parts, are neither referred to nor illustrated. If heat insulating structures are formed out of a ceramic material, such as silicon nitride ($Si_3N_4$), and a heat insulating material for the cylinder, piston and suction and exhaust valves, the heat insulating purpose can, of course, be achieved more reliably. The head liner 1 consisting of an integrated structure of the lower surface portion 2 of the head and the upper portion 3 of the cylinder liner is fitted via a heat insulating material in a cylindrical portion of a cylinder head, which is provided with, for example, a suction port and an exhaust port, and, in addition to them, a fuel injection nozzle port in a diesel engine. A description of the head liner fitting method is omitted in this specification.

As shown in FIGS. 1 and 2, the heat insulating combustion chamber 10 according to the present invention is provided with a thin film member, i.e. a thin layer 4, which is formed on the parts, which are on the side of the interior of the combustion chamber 5, of the head liner 1, which consists of an integrated structure of the lower surface portion 2 of the head and the upper portion 3 of the cylinder liner, via a heat insulating layer consisting of carbon 6 and an air layer 8. The head liner 1 consists of a ceramic material, such as silicon nitride ($Si_3N_4$), and the lower surface portion 2 of the head liner 1 is provided with suction and exhaust valve seats 17 (only one of which is shown in FIG. 2). The thin layer 4 is formed to small thickness by the chemical vapor deposition of a ceramic material, such as silicon nitrode ($Si_3N_4$) so that the thermal capacity of the layer becomes small. A latticed partition 7 consisting of a ceramic material, such as silicon nitrode ($Si_3N_4$) is provided in a vertically fixed state between the thin layer 4 and head liner 1, and a heat insulating layer is formed between the wall members 7 of this partition 7. The heat insulating layer consists of a porous structure composed of carbon 6 as heat insulating material, and pores 8 in the same material.

Figure 3:
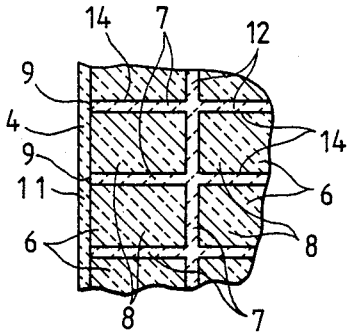
FIG. 3 is an enlarged sectional view taken along the line III—III in FIG. 2.

The heat insulating combustion chamber 1 constructed as described above can be formed by the following manufacturing method. First, a ceramic material, such as silicon nitride ($Si_3N_4$) is injected from a nozzle, for example, a T-shaped nozzle or a cross-shaped nozzle of an injection molding machine into a mold, and a latticed partition 7 is thereby injection molded, the partition 7 being used to integrally mold a portion 12 positioned on the lower surface of the head and a portion 13 positioned on the upper section of the cylinder liner. For example, as shown in FIG. 3, carbon powder is then packed in a plurality of cross-sectionally rectangular spaces 14 formed among the wall members of the partition 7, to obtain a molded product consisting of a compound material, i.e. a compound product. The inner surface of this compound product is polished so that the surfaces of the carbon 6 and wall members of the partition 7 are exposed alternately on the same inner surface. In other words, the polishing is done so that rectangular surface portions defined by the wall members of the partition 7 are exposed on the inner surface of the compound product. The compound product the inner surface of which has been polished is fitted in a contacting state in the inner surface of the head liner 1 which consists of an integrated structure of the lower surface portion 2 of the head and the upper portion 3 of the cylinder liner, and which are composed of a ceramic material, such as silicon nitride ($Si_3N_4$). The resultant product is placed in a chemical vapor deposition furnace and subjected to the chemical vapor deposition of a ceramic material, such as silicon nitride ($Si_3N_4$) to form a thin layer 4, which consists of a film of this ceramic material, on the whole of the exposed inner surfaces of the partition 7 and carbon 6. Since the partition 7 and thin layer 4 consist of the same ceramic material, they are conbined very firmly at the joint portions 9, the thin layer 4 being formed as a layer of coating 11 on the partition 7 and carbon 6. This thin layer 4 is positioned on the side facing the combustion chamber 5 of the engine. When the exposed surface of the compound product is subjected to chemical vapor deposition to increase the temperature thereof, the oxygen contained among the particles of the carbon powder performs an oxidation reaction with a part of the carbon 6 to be turned into carbon dioxide. These portions of the generated carbon dioxide turn into pores 8 among the particles of the carbon 6, so that the carbon 6 among the latticed body of the partition 7 is formed into porous structures. Namely, the cross-sectionally rectangular portions 14 defined by the partition 7 are formed into heat insulating layers each of which consists of carbon and air layers. The spaces, which are formed to a cross-sectionally rectangular shape, among the walls of the partition 7 shown in the drawings may, of course, be formed to any other shape, for example, a cross-sectionally square shape, a cross-sectionally triangular shape and a cross-sectionally hexagonal shape. Moreover, since the latticed body of the partition 7 functions as a support, the thin layer 4 is supported very firmly by the partition 7. Therefore, the thin layer 4, which consists of a thin film, can serve as a member of a high strength facing the combustion chamber 5 of the engine. Moreover, since the carbon 6 is packed in the latticed partition so that the density and thermal conductivity of the carbon become low, very good heat insulating performance can be obtained owing to the heat insulating layer consisting of the porous structures of the carbon 6, though a part of the carbon 6 is oxidized at a high temperature. A layer of coating 11 of a ceramic material, such as silicon nitride ($Si_3N_4$) is formed on the inner surface of a passage 18 for the suction and exhaust valves, which is formed in the lower surface portion 2 of the head, and this layer of coating 11 is covered with a thin layer 4.

Since the heat insulating combustion chamber 10 according to the present invention is constructed as described above, the thin layer 4, a ceramic member, provided on the inner surface of the cylinder head liner 1 and exposed to the high-temperature gas in the combustion chamber 5 of the engine can be formed to the smallest possible thickness by chemical vapor deposition, whereby the thermal capacity of the thin layer 4 can be reduced. In order to prevent the reduced thickness of the thin layer 4 from causing the strength of the same layer to decrease, this layer 4 is strengthened by applying the latticed ceramic partition 7 to the outer side thereof. Owing to the heat insulating layer consisting of the carbon 6 packed among the walls of the partition 7 and pores 8, the heat insulating performance of the heat insulating combustion chamber can be improved.

What is claimed is:

1. A heat insulating combustion chamber comprising:
   - a lower surface portion of a head, which is provided with suction and exhaust ports, and which consists of a ceramic material,
   - an upper portion of a cylinder liner, which is formed integrally with said lower surface portion of said head, and which consists of a ceramic material,
   - a head liner consisting of said lower surface portion of said head and said upper portion of said cylinder liner,
   - a combustion chamber formed on the inner side of said head liner,
   - a latticed partition fixed in a vertically standing state to the inner surface of said head liner and consisting of a ceramic material,
   - carbon packed in hollow spaces formed by said partition, and
   - a thin layer of a ceramic material formed so as to cover the whole of the inner surfaces of said partition and said carbon.

2. A heat insulating combustion chamber according to claim 1, wherein said ceramic material consisting said head liner, said partition and said thin layer is silicon nitride.

3. A heat insulating combustion chamber according to claim 1, wherein said thin layer is bonded to said partition by chemical vapor deposition of a ceramic material.

4. A heat insulating combustion chamber according to claim 1, wherein said carbon is packed in the hollow spaces among the walls of said partition so that density and thermal conductivity thereof becomes low.

5. A heat insulating combustion chamber according to claim 1, wherein a part of said carbon packed in the hollow spaces among the walls of said partition reacts with oxygen, which exists among said walls, during a chemical vapor deposition operation, so that said carbon among said walls are formed into porous structures.

6. A heat insulating combustion chamber according to claim 1, wherein said partition functions as a support member for receiving the force imparted to said thin layer.

7. A heat insulating combustion chamber according to claim 1, wherein said head liner is fitted in a cylindrical portion formed on a cylinder head provided with suction and exhaust ports.

8. A method of producing a heat insulating combustion chamber, comprising the steps of:

forming a head liner consisting of a lower surface portion of a head, which is composed of a ceramic material, and an upper portion of a cylinder liner, which is formed integrally with said lower surface portion of said head and composed of a ceramic material, forming a partition of a ceramic material to the shape of a lattice so that said partition has a contour permitting said partition to be fitted in a contacting state into the whole of the inner surface of said head liner, packing carbon powder in hollow spaces among the walls of said partition to form a compound body consisting of a ceramic material and carbon, polishing the inner surface of said compound body so that the inner surfaces of said partition and said carbon are exposed alternately, fitting said compound body in said head liner, which consists of said lower surface portion of said head and said upper portion of said cylinder liner, in such a manner that the outer surface of the former contacts the inner surface of the latter, subjecting a ceramic material to chemical vapor deposition after said compound body has been fitted in said head liner, so as to form a thin layer on the inner surface of said compound body, and covering the whole of the inner surface of said compound body with said thin layer which is formed by said chemical vapor deposition of a ceramic material, to combine said partition and said thin layer with each other.

9. A method of producing a heat insulating combustion chamber according to claim 8, wherein oxygen contained in said partition and said carbon react with each other to generate carbon dioxide in said step of carrying out the chemical vapor deposition of a ceramic material on said partition which constitutes said compound body, whereby said carbon in said partition is formed into porous structures owing to said carbon dioxide.

10. A method of producing a heat insulating combustion chamber according to claim 8, wherein said step of forming a partition out of a ceramic material to the shape of a lattice so that said partition has a contour permitting said partition to be fitted in a contacting state in the whole of the inner surface of said head liner can be carried out by injecting a ceramic material, such as silicon nitride from a nozzle, for example, a T-shaped nozzle or a cross-shaped nozzle of an injection molding machine into a mold to injection-mold the partition which is used to integrally mold a portion positioned on the lower surface of said head and a portion positioned on the upper section of said cylinder liner.

* * * * *